US012753356B2

(12) United States Patent
Cui et al.

(10) Patent No.: US 12,753,356 B2
(45) Date of Patent: Oct. 6, 2026

(54) FULLY MODULARIZED PYROLYSIS REACTOR WITH SIMULTANEOUS MULTI-FEED CAPABILITIES

(71) Applicant: HARVESTGREEN 4H2 INC., Ottawa (CA)

(72) Inventors: Maopei Cui, Ottawa (CA); Xiaoxia Li, Xuzhou City (CN)

(73) Assignee: HARVESTGREEN 4H2 INC. (CA)

( * ) Notice: Subject to any disclaimer, the term of this patent is extended or adjusted under 35 U.S.C. 154(b) by 84 days.

(21) Appl. No.: 18/775,648

(22) Filed: Jul. 17, 2024

(65) Prior Publication Data

US 2025/0313766 A1 Oct. 9, 2025

(30) Foreign Application Priority Data

Apr. 3, 2024 (CN) ..... 202410401265.6
Apr. 3, 2024 (CN) ..... 202420680314.X

(51) Int. Cl.
*C10J 3/22* (2006.01)
*C10B 1/04* (2006.01)
(Continued)

(52) U.S. Cl.
CPC ..... *C10J 3/22* (2013.01); *C10B 1/04* (2013.01); *C10B 49/02* (2013.01); *C10B 49/04* (2013.01);
(Continued)

(58) Field of Classification Search
CPC ..... F23K 2203/202; F23B 1/24
See application file for complete search history.

(56) References Cited

U.S. PATENT DOCUMENTS 596,018 A * 12/1897 Kitson ..... C10J 3/34 48/66
1,341,044 A * 5/1920 Chapman ..... C10J 3/32 48/85.1
(Continued)

FOREIGN PATENT DOCUMENTS

CN 103382402 A * 11/2013
CN 112680239 A * 4/2021

OTHER PUBLICATIONS

PE2E translation of CN 103382402 A.*
PE2E translation of CN 112680239 A.*

*Primary Examiner* — Jonathan Luke Pilcher
(74) *Attorney, Agent, or Firm* — Emerson, Thomson & Bennett, LLC; Roger D. Emerson; Peter R. Detorre

(57) ABSTRACT

A fully modularized mid-feed pyrolysis reactor includes modularized upper, middle, and lower vessels. The middle vessel is equipped with at least two feeding units. Discharge pipes of the feeding units are placed into the core feeding and reaction zone of the reactor. The discharge outlets of the discharge pipes are equipped with heat-insulating valves that can automatically close under gravity. The lower vessel integrates an integrated grate, which can be rotatably arranged inside the lower vessel. The top of the integrated grate is equipped with a rotatable distributor including a support tray and a material distribution tower with a pointed top structure positioned at the center of the support tray. The bracket formed by water-cooling pipes on the distributor can act as an agitator. Under the premise of achieving precise control, this invention solves the technical problems of single feedstock and small reactor capacity in existing bottom-feed vertical pyrolysis reactors.

4 Claims, 2 Drawing Sheets

(51) Int. Cl.

| | |
|---|---|
| ***C10B 49/02*** | (2006.01) |
| ***C10B 49/04*** | (2006.01) |
| ***C10B 53/02*** | (2006.01) |
| ***C10B 57/04*** | (2006.01) |
| ***C10J 3/30*** | (2006.01) |
| ***C10J 3/32*** | (2006.01) |
| ***C10J 3/34*** | (2006.01) |
| ***C10J 3/42*** | (2006.01) |
| ***C10J 3/72*** | (2006.01) |

(52) U.S. Cl.
CPC ..... *C10B 53/02* (2013.01); *C10B 57/04* (2013.01); *C10J 3/30* (2013.01); *C10J 3/32* (2013.01); *C10J 3/42* (2013.01); *C10J 3/72* (2013.01); *C10J 2200/09* (2013.01); *C10J 2200/15* (2013.01); *C10J 2200/31* (2013.01)

(56) References Cited

U.S. PATENT DOCUMENTS 1,441,330 A * 1/1923 Chapman ..... C10J 3/32 48/85.2
1,527,879 A * 2/1925 Koller ..... C10J 3/34 126/182
1,872,883 A * 8/1932 Byrne ..... C10K 3/008 201/31
2,126,150 A * 8/1938 Stryker ..... C10B 49/08 48/209
2,216,792 A * 10/1940 Stryker ..... C10J 3/20 48/DIG. 4
2,506,782 A * 5/1950 Fallon ..... C10J 3/32 110/165 R
4,014,664 A * 3/1977 Kupfer ..... C10J 3/42 48/68
4,146,369 A * 3/1979 Flesch ..... C10J 3/76 252/373
4,200,438 A * 4/1980 Kaimann ..... C10J 3/523 201/31
4,225,392 A * 9/1980 Taylor ..... C10B 1/04 48/85
4,659,340 A * 4/1987 Weaver ..... C10J 3/36 48/68
7,794,514 B2 * 9/2010 Yu ..... C10J 3/20 48/77
2016/0068757 A1 3/2016 Cui et al.
2024/0010941 A1 * 1/2024 Francu ..... C10J 3/723
2025/0313755 A1 * 10/2025 Cui ..... C10B 31/02
2025/0313767 A1 * 10/2025 Cui ..... C10B 53/02

* cited by examiner

FULLY MODULARIZED PYROLYSIS REACTOR WITH SIMULTANEOUS MULTI-FEED CAPABILITIES

TECHNICAL FIELD

The present invention relates to the field of energy, particularly renewable bioenergy, and more particularly to a fully modularized pyrolysis reactor with simultaneous multi-feed capabilities.

BACKGROUND ART

Biomass pyrolysis refers to the thermal chemical conversion technology method in which biomass is heated to 250~700° C. in the absence of oxidants (such as air, oxygen, water vapor, etc.) or with limited oxygen, and the macromolecular substances of biomass (lignin, cellulose, and hemicellulose) are decomposed into smaller molecular fuel substances (solid carbon, combustible gas, bio-oil) through thermal chemical reactions. From the perspective of chemical reactions, complex thermal chemical reactions occur in biomass during the pyrolysis process, including molecular bond cleavage, isomerization, and small molecule polymerization reactions. (Zhao Tinglin, Wang Peng, Deng Dajun, et al. Research status and prospects of biomass pyrolysis [J]. New Energy Industry, 2007, 5:54-60).

The products of biomass pyrolysis are combustible pyrolysis gas and solid biomass charcoal, both of which are products that can be used for energy applications. In addition to being used as heating fuel, pyrolysis gas can also be further reformed into raw materials for power generation and the synthesis of green liquid fuels; biomass charcoal has many additional values besides being used as fuel, including use in metal smelting, food and light industry fuels, reducing agents in electric furnace smelting, and coverings to protect metals from oxidation during refining. It is also used as raw materials for chemical industry products such as carbon disulfide and activated carbon. Due to the Chinese government's prohibition of using wood to make charcoal, the market for biomass charcoal is broad.

Chinese patent CN201210590914.9 discloses a vertical pyrolysis reactor. It includes a reactor vessel, a feeding unit, a biomass gas outlet at the top of the reactor, an ash discharge unit at the bottom of the reactor, and a grate inside the reactor. The feeding device is located at the bottom of the reactor, and the outlet of the feeding device is located at the center of the bottom of the reactor.

Application number CN201220748018.6, Patent Name: A precision-controlled vertical pyrolysis reactor, includes a reactor vessel, a feeding unit, a biomass gas outlet at the top of the reactor, an ash discharge device at the bottom of the reactor, and a grate inside the reactor. The feeding unit is located at the bottom of the reactor, and the outlet of the feeding device is located at the center of the bottom of the reactor. By adopting the method of bottom-center feeding, the problem of uneven feeding, which has long plagued biomass pyrolysis reactors, is solved; an agglomeration-breaking device is installed in the pyrolysis reactor and organically combined with the rotating grate. The operating speed of the grate can be precisely adjusted to control the discharge amount. Precise control of the pyrolysis reaction is achieved by controlling the feed rate, discharge rate, bed thickness, air intake volume, air distribution, reaction temperature, etc. The ash discharge of the pyrolysis reactor is more stable and continuous, and the reliability of production is greatly improved; the position design of the feeding device and the coordinated use of the agglomeration-breaking device can effectively continuously process biomass with a size of up to about 10 cm.

However, the above-mentioned bottom-fed vertical pyrolysis reactors have technical issues such as single feedstock and limited reactor capacity.

SUMMARY OF EMBODIMENTS

To solve the technical issues of single feedstock and limited reactor capacity in the existing bottom-feed vertical pyrolysis reactor, this application proposes a fully modularized mid-feed pyrolysis reactor, which solves the above-mentioned technical issues.

The present invention provides a fully modularized mid-feed pyrolysis reactor, comprising:

- A modularized upper vessel, which is equipped with a product gas collecting pipeline;
- A modularized middle vessel, which is detachably connected to the upper vessel and is equipped with at least two feeding units. Different feedstock materials (with different high or low calorific values, or materials requiring special treatment, etc.) can be input simultaneously without any waiting time of switch feedstocks if using same feeding unit. The discharge pipe of the feeding device is inserted into the interior of the middle vessel, and a heat-insulating valve that can automatically close under gravity is arranged at the discharge port of the discharge pipe;
- A modularized lower vessel, which is detachably connected to the middle vessel and integrates an integrated grate. The integrated grate is rotatably arranged inside the lower vessel, and a rotatable distributor is arranged at the top of the integrated grate. The distributor includes a support tray and a material distribution tower with a pointed top structure located at the center of the support tray. The material dropped from the discharge port falls first onto the pointed top structure of the material distribution tower for primary distribution. After primary distribution, the material falls uniformly onto the outer circumference of the support tray for secondary distribution, and then falls more uniformly onto the surface of the integrated grate.

Further, the discharge port of the discharge pipe of the feeding device is arranged directly above the distributor to evenly distribute the feedstock material, and it is close to the distributor so that the discharge pipe is inserted into the core feeding area and reaction area inside the pyrolysis reactor.

Furthermore, the discharge pipe of the feeding unit is equipped with an external insulation structure to isolate the temperature inside the pyrolysis reactor, prevent the temperature inside the discharge pipe from being too high, and avoid heat loss. The external insulation structure can be a thermal insulation refractory layer, a water-cooled insulation device, or an air-cooled insulation device.

Furthermore, the bottom of the discharge pipe of the feeding unit protrudes at the bottom of the end pipe of the discharge pipe, so that the heat-insulating valve is closed in an inclined state at the discharge port. At the same time, the heat-insulating valve is rotatably arranged at the discharge port, and the moving device of the heat-insulating valve is arranged at the top of the end pipe of the discharge pipe.

Furthermore, the feedstock material distribution tower is rotatably arranged on the support tray.

Furthermore, the feedstock material distribution tower is also equipped with blades for extruding the feedstock material outward.

Furthermore, a seat fixedly connected to the lower vessel is arranged between the distributor and the integrated grate, and the outer periphery of the seat wraps upward to form a dustproof cap that envelops the support tray.

Furthermore, the seat is connected with multiple fixed pipelines. One end of the pipeline is connected to the lower vessel, and the other end is connected to the seat. The pipelines are arranged above the surface of the integrated grate and serve to stir the material on the surface of the integrated grate and play a role in stirring the material. This is conducive to precisely controlling the reaction process.

Furthermore, the pipeline is a hollow structure, and circulating cooling water flows inside the hollow structure.

Furthermore, the integrated grate is integrated with an air inlet pipe, and the air inlet of the air inlet pipe is formed at the bottom of the integrated grate.

Furthermore, it also includes a modularized ash/char discharge seat that can be integrally integrated with the lower vessel. The ash/char discharge seat is detachably arranged at the bottom of the lower vessel. At the same time, a circular ash/char discharge port is formed at the bottom of the surface of the integrated grate, and the waste residue after the reaction enters the ash/char discharge seat through the ash/char discharge port.

Furthermore, the connections between the upper vessel, middle vessel, lower vessel, and ash/char discharge seat are all ring fittings, allowing modular assembly with adjustable orientation in any direction horizontally.

Based on the above technical solution, the technical effects that the present invention can achieve are:

The fully modularized mid-feed pyrolysis reactor of the present invention is equipped with at least two feeding units on the middle vessel, which can simultaneously input at least two kinds of feedstock materials. The feeding volume and the reactor capacity can be relatively large, about 4-10 times the capacity of the bottom-fed reactor. The requirements for the particle size of the material are also relatively low, and the requirements for the fineness of the material itself are low. The processing capacity is also larger. The discharge port of the discharge pipe is equipped with a heat-insulating valve that can automatically close under gravity. One of the drawbacks of top feeding is that hot air will enter the feeding device from the discharge pipe route, affecting the materials that do not need to react and the gas collection volume. The automatically closing heat-insulating valve can ensure that the material in the feeding device is not affected and prevent the loss of hot gas. Compared with the traditional top-fed pyrolysis reactor, the feeding position of the pyrolysis reactor of the present invention is actually in the middle of the reactor, and the gas collecting pipeline is arranged at the top of the reactor. It is easier for the hot product pyrolysis gas to enter the gas collecting pipeline. At the same time, the discharge port of the discharge pipe is arranged in the middle, and the drop height of the material is reduced, which can effectively control the drop trajectory of the material. Furthermore, a distributor is arranged at the top of the lower vessel. The distributor includes a support tray and a material distribution tower with a pointed top structure located at the center of the support tray. The material dropped from the discharge port falls first onto the pointed top structure of the material distribution tower for primary distribution. After primary distribution, the material falls uniformly onto the outer circumference of the support tray for secondary distribution, and then falls more uniformly onto the surface of the integrated grate, making the reaction control of the material more accurate. On the other hand, the fully modularized mid-feed pyrolysis reactor of the present invention can be modularly manufactured. It can be pre-installed by professional technicians, including electrical and monitoring systems, in the workshop of the reactor manufacturer, and undergo comprehensive cold and hot debugging, and then modularly transported to the site, avoiding rough installation by non-professional construction personnel at the site, reducing 90% of the on-site installation time, and ensuring the installation quality. Modular installation also ensures that the angles of feeding, air intake, charcoal discharge, gas discharge, etc., can be adjusted at any direction. In the case of standardized modular equipment, the angles of various installations can be adjusted like building blocks to meet the on-site needs of customers without changing the overall design of the pyrolyzer itself.

EXPLANATION of SYMBOLS

1—Upper vessel, 11—Gas collection pipeline, 2—Middle vessel, 21—Feeding unit, 211—Discharge pipe, 212—Heat insulation valve, 3—Lower vessel, 31—Integrated grate, 32—Distributor, 321—Support tray, 322—Material distribution tower, 323—Blade, 33—Seat, 331—Dustproof cap, 34—Water coolingWater-cooling pipeline, 35—Air inlet pipe, 36—Ash/char discharge port, 37—Manhole, 4—Ash/char discharge seat, 38—End water-cooling pipeline, 213—Hinge or pivot axis.

DETAILED EMBODIMENT

The following description of exemplary embodiments, combined with the accompanying drawings, provides a clear and comprehensive explanation of the technical solutions in the embodiments of the present invention. It is evident that the described embodiments are only a part of the embodiments of the present invention, rather than all embodiments. The description of at least one exemplary embodiment is merely illustrative and should not be construed as limiting the present invention and its applications or uses. Based on the embodiments of the present invention, all other embodiments obtained by those skilled in the art without inventive work are within the scope of protection of the present invention.

Figure 1:
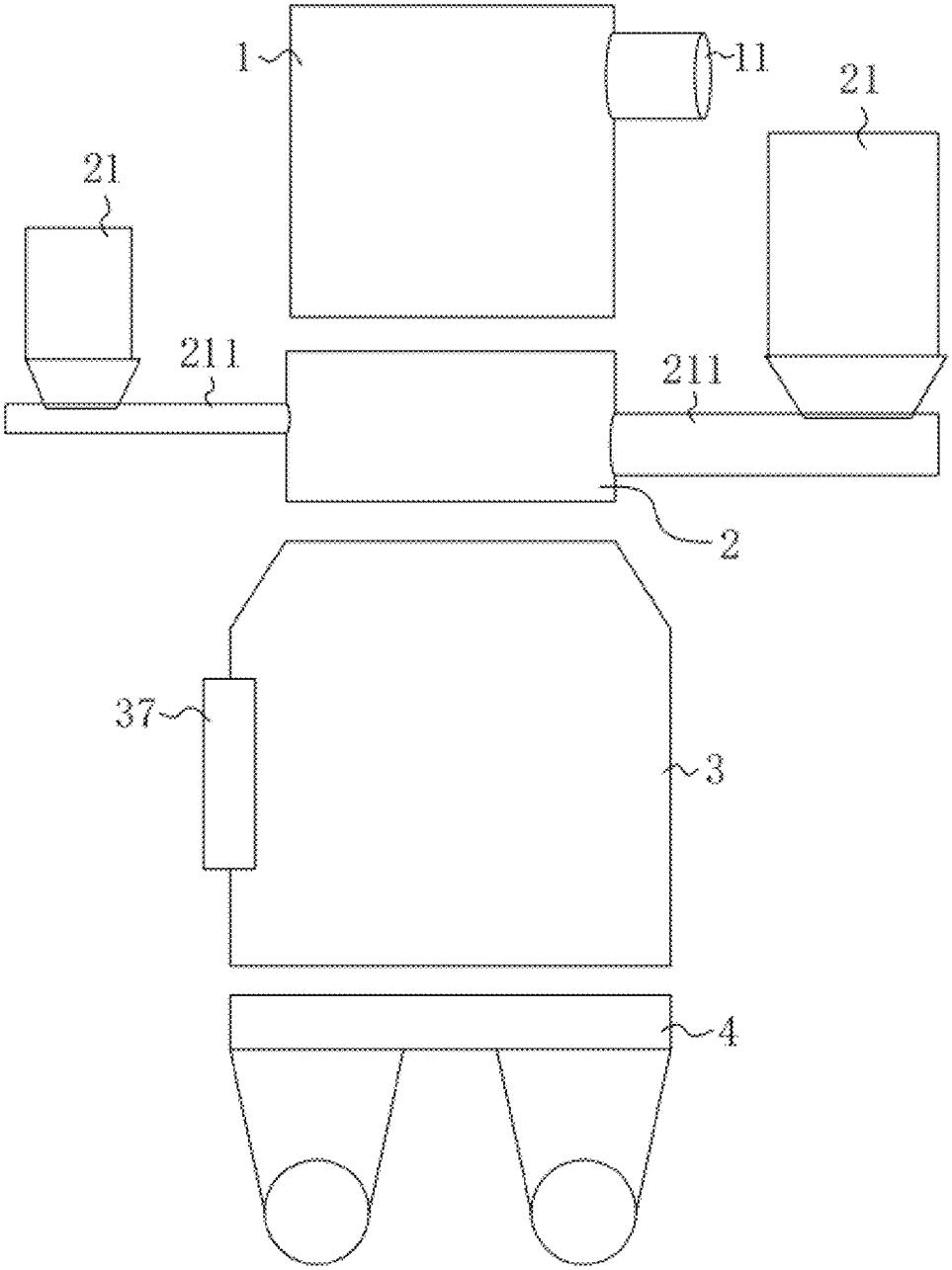
FIG. 1 shows a schematic diagram of the fully modularized mid-feed pyrolysis reactor of the present invention.
Figure 2:
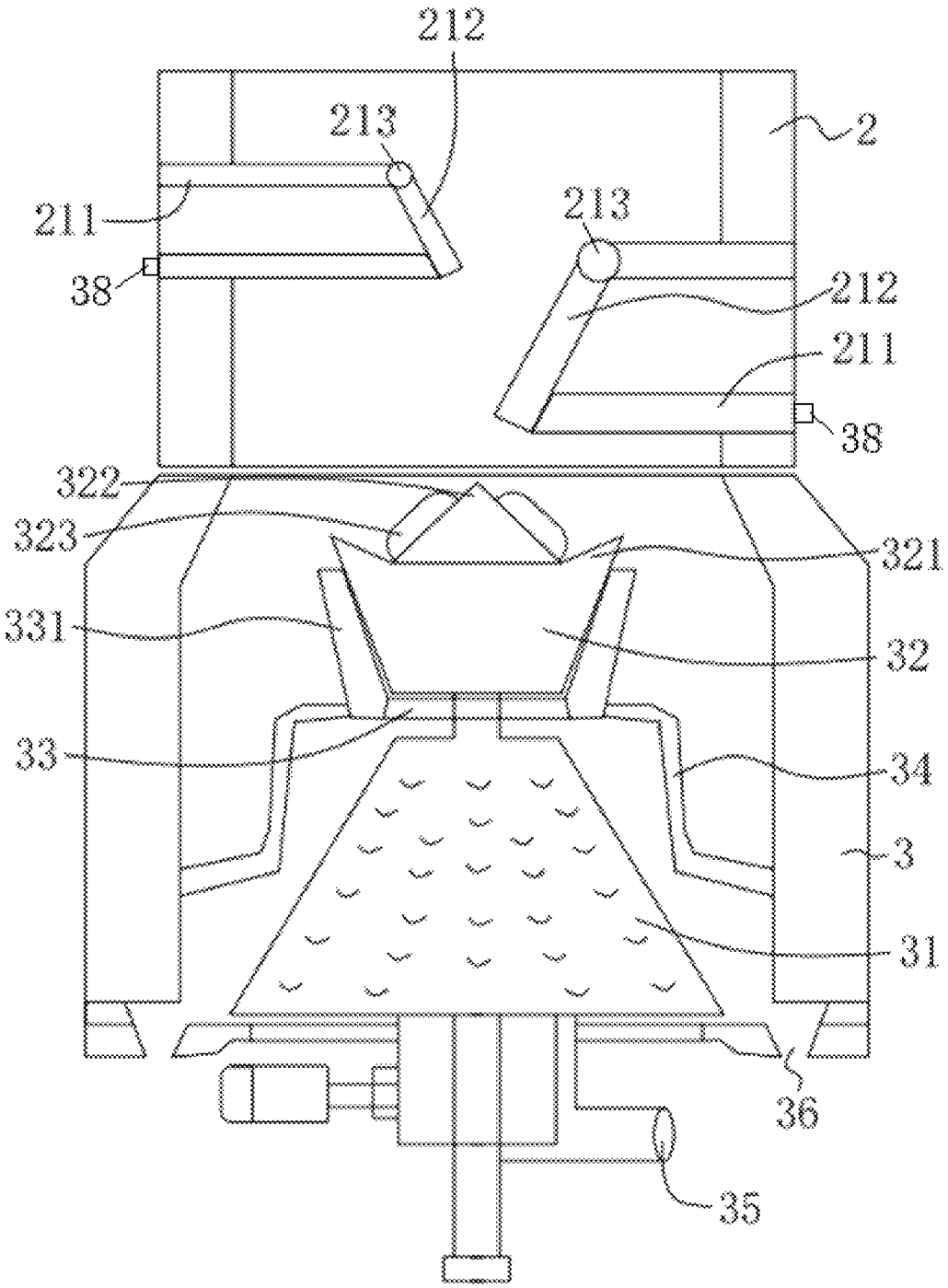
FIG. 2 shows the internal structure schematic diagram of the middle vessel and lower vessel of the fully modularized mid-feed pyrolysis reactor of the present invention.

The present invention provides a fully modularized mid-feed pyrolysis reactor, as shown in FIGS. 1 and 2. The reactor comprises a modular upper vessel (1), a modular middle vessel (2), and a modular lower vessel (3).

The upper vessel (1) is equipped with a gas collection pipeline (11) for collecting the product gases after the reaction. The middle vessel (2) is detachably connected to the upper vessel (1) and is equipped with at least two feeding units (21) for simultaneous feeding of main and/or auxiliary materials. The discharge pipe (211) of the feeding unit (21) is inserted into the interior of the middle vessel (2), and a heat insulation valve (212) is provided at the discharge port of the discharge pipe (211) to automatically close under the action of gravity, preventing hot gas inside the reactor from backflowing the feeding unit. The heat insulation valve (212) is rotatably mounted about a hinge or pivot axis (213) located above the discharge port.

The lower vessel (3) is detachably connected to the middle vessel (2) and integrates a integrated grate (31). The integrated grate (31) is rotatably arranged within the lower vessel (3), and a rotatable distributor (32) is provided at the top of the integrated grate (31). The distributor (32) includes a support tray (321) and a material distribution tower (322) with a pointed top structure. Material falling from the discharge port first falls onto the pointed top structure of the material distribution tower (322) for primary distribution, then uniformly onto the outer circumference of the support tray (321) for secondary distribution, and finally onto the surface of the integrated grate (31).

In one embodiment of the present invention, the feeding unit (21) is capable of simultaneously feeding at least two different feedstock materials. This is necessary in certain pyrolysis environments, such as when pyrolyzing sludge with low calorific value. If the sludge calorific value is too low and the pyrolysis reaction may be interrupted, immediately inputting wood chips with a relatively high calorific value can ensure the continuity and stability of the reaction and pyrolysis gas. Moreover, if it is the same feeding port, the material needs to be changed outside the reactor and before the discharge port, which incurs low automation and high labor costs. It is difficult to ensure the quality of pyrolysis. For example, certain special solid wastes (such as RDF or plastic film, etc.) have their own special input methods and require their own unique discharge pipes (211) feeding systems.

The fully modularized mid-feed pyrolysis reactor of the present invention allows for a relatively large feeding capacity and reactor volume, approximately 4-10 times that of a bottom-feed reactor. It has relatively low requirements for material particle size and finesse, and has a higher processing capacity. The discharge pipe (211) is equipped with a thermal insulation valve (212) that automatically closes under the action of gravity. One drawback of top feeding is that hot product gas may enter the feeding unit (21) through the discharge pipe (211), affecting materials that do not require reactions and the volume of gas collection. The automatic closing heat insulation valve (212) ensures the material in the feeding device (21) and prevents the loss of hot product gas. Compared to traditional top feeding reactors, the feeding position of the pyrolysis reactor of the present invention is actually in the middle of the reactor, close to the core reaction zone, without disturbing the composition and yield of pyrolysis gas products. The gas collection pipe (11) is configured at the top of the reactor, making it easier for the hot product gas to rise into the gas collection pipe (11). Meanwhile, the discharge port (211) is located in the middle, reducing the drop height of the material and effectively controlling the trajectory of its fall. Furthermore, a rotatable distributor (32) is installed at the top of the bottom vessel (3). The distributor (32) includes a support tray (321) and a material distributor tower (322) with a pointed top structure located at the center of the support tray (321). The material falling from the discharge port first falls onto the pointed top structure of the material distributor tower (322) for primary distribution. After primary distribution, the material falls evenly onto the outer circumference of the support tray (321) for secondary distribution before falling more evenly onto the surface of the integrated grate (31), ensuring more precise control over the reaction of the material.

Additionally, the present invention's fully modularized mid-feed pyrolysis reactor allows for modular manufacturing, where all components can be pre-installed in the workshop of the reactor manufacturer by professional technicians, including electrical and monitoring systems. This modularized assembly unit can then be transported to the site, reducing installation time by 90% while ensuring installation quality. Moreover, modular installation allows for adjustments to be made to the angles of feeding, air intake, charcoal discharge, and gas discharge, meeting the specific site requirements without altering the overall design of the pyrolysis reactor. In conclusion, the modular design not only maximizes commercialization but also enables precise control of the pyrolysis reaction.

In further embodiments of the present invention:

The discharge port of the feeding device (21) is located above and adjacent to the distributor (32) to ensure uniform distribution of materials.

The pyrolysis reactor of the present invention differs from conventional reactors, such as vertical kilns. In reality, it feeds from the midsection, with the discharge pipe (211) of the feeding device (21) extending directly into the core area of the pyrolysis reactor. The height from the top of the integrated grate (31) to the distributor (32) is less than 1 meter, while there is still a height of 4-8 meters above the discharge pipe (211) inside the pyrolysis reactor. In conventional reactors, the material is sprinkled from the highest point, the 8-meter-high furnace roof, making it difficult to ensure even distribution on the surface of grate (31). All feeding units (21) effectively deliver the material directly to the upper part of the reaction core, without affecting the gas reaction above. This ensures that the material is steadily and accurately delivered directly above the integrated grate (31), ensuring that the material falls onto the distributor (32) on the integrated grate (31) and is evenly spread. Evenly spreading the material on the integrated grate (31) is necessary to achieve precise control of the pyrolysis reaction. Unevenly distributed material on the integrated grate (31) imply the possibility of local high temperatures and burn-through, making it difficult to ensure precise control, stabilize the pyrolysis gas products, and ensure the composition of the pyrolysis gas used to produce other high-quality biomass synthesis gas.

In a preferred embodiment of the present invention, an external insulation structure is provided on the discharge pipe (211) to insulate the temperature inside the pyrolysis reactor, preventing the temperature inside the discharge pipe (211) from becoming too high. The external insulation structure may include an insulation layer, a water-cooled insulation device, or an air-cooled insulation device.

In a preferred embodiment of the present invention, the bottom of the end water-cooling pipeline 38 of the discharge pipe 211 of the feeding device 21 protrudes to allow the heat insulation valve 212 to close the discharge port in an inclined state. At the same time, the heat insulation valve 212 is configured to be rotatable at the discharge port, and the moving device of the heat insulation valve 212 is located at the top of the end water-cooling pipeline 38 of the discharge pipe 211. This design reduces the resistance of the material pushing the heat insulation valve 212 and ensures that the heat insulation valve 212 can automatically close under the action of gravity. Furthermore, the center of gravity of the heat insulation valve 212 is lowered to ensure the stability of its automatic closing function. The center of gravity can be lowered by adding a counterweight at the bottom position of the heat insulation valve 212 or by increasing the thickness of the bottom position of the heat insulation valve 212.

In further embodiments of the present invention:

The discharge pipe (211) inserted into the furnace body is provided with insulation to insulate and insulate the inner part of the pyrolysis reactor.

Furthermore, the material distribution tower (322) is rotatably arranged on the support tray (321) to ensure better and more uniform distribution of materials, and the blades (323) are further provided on the material distribution tower (322) for extruding materials.

Additionally, a seat (33) fixedly connected to the lower vessel (3) is provided between the distributor (32) and the integrated grate (31), and the outer periphery of the seat (33) wraps upwardly around the support tray (321) to form a dustproof cap (331) to reduce dust entering the shaft and motor of the integrated grate (31).

Moreover, multiple fixed water-cooling pipelines (34) are connected to the seat (33). One end of the water-cooling pipelines (34) is connected to the lower vessel (3), and the other end is connected to the seat (33). The water-cooling pipelines (34) are arranged above the surface of the integrated grate (31) to move the materials on the surface of the integrated grate (31) and prevent arching and bridging of the materials on the surface of the integrated grate (31).

The water-cooling pipelines (34) have a hollow structure through which circulating cooling water flows to cool and assist in precise temperature regulation inside the reactor.

In a preferred embodiment of the present invention, an air inlet pipe 35 is integrated on the integrated grate 31, and the air inlet of the air inlet pipe 35 is formed at the bottom of the integrated grate 31. This is a manifestation of the integrated modular design of the lower vessel 3 and the integrated grate 31 on the lower vessel 3 of the present invention.

Additionally, a modular ash/char discharge unit (4) integrated with the lower vessel (3) is detachably disposed at the bottom of the lower vessel (3). The bottom of the surface of the integrated grate (31) and the inner wall of the lower vessel (3) form a circular ash/char discharge port (36), and the waste residue after the reaction enters the ash/char discharge unit (4) through the ash/char discharge port (36). This is also a manifestation of the complete modular design of the pyrolysis reactor of the present invention. Each part can be pre-selected and fully installed by professionals in the workshop. Electrical and monitoring components can also be installed in the workshop. Now, only simple assembly by non-professionals is required, which can save 90% of the installation time and ensure installation quality.

In a specific embodiment of the present invention, the connection between the upper vessel (1), middle vessel (2), lower vessel (3), and Ash discharge unit (4) are all designed as circular rings. This allows for modular assembly with adjustable orientation in the horizontal direction, similar to building blocks. The lower vessel 3 is equipped with a manhole 37, and the main modular components can be combined in any direction to meet various customer needs. For example, the orientation of the feeding unit 21, manhole 37, gas collection pipe 11, and ash/char discharge seat 4 can be changed as needed without altering the overall design of the pyrolysis reactor itself. This design significantly reduces the customization time for customer-specific products.

A manhole (37) is provided in the lower vessel (3) for providing access to the interior thereof.

It should be understood that the specific embodiments described above are only for the purpose of explaining the present invention and not for limiting the present invention. Obvious changes or modifications derived from the spirit of the present invention are still within the scope of the present invention.

What is claimed is:

1. A pyrolysis reactor, comprising:

an upper vessel (1), the upper vessel (1) being provided with a gas collection pipeline (11);

a middle vessel (2), the middle vessel (2) being detachably connected to the upper vessel (1), the middle vessel (2) being provided with at least two feeding units (21), each feeding unit (21) of the at least two feeding units (21) having a discharge pipe (211) positioned into an inside of the middle vessel (2), and a discharge port of each discharge pipe (211) being provided with a heat insulation valve (212) configured to be automatically closed under gravity; and a lower vessel (3), the lower vessel (3) being detachably connected to the middle vessel (2), an integrated grate (31) being rotatably provided inside the lower vessel (3), a top of the integrated grate (31) being provided with a rotatable distributor (32), the rotatable distributor (32) comprising a support tray (321) and having a material distribution tower (322) with a pointed top structure, the material distribution tower (322) being provided at a center of the support tray (321), materials falling from the discharge port first falling to the pointed top structure of the material distribution tower (322) for primary distribution, and the materials after primary distribution evenly falling to an outer circumference of the support tray (321) for secondary distribution, and then more evenly falling to a surface of the integrated grate (31);

wherein the discharge port of each discharge pipe (211) is positioned above the rotatable distributor (32) and adjacent to the rotatable distributor (32), such that each discharge pipe (211) is inserted into a core feed zone and a reaction zone inside the pyrolysis reactor;

wherein, for each discharge pipe (211), an end water-cooling pipeline (38) is arranged at an end portion of the discharge pipe (211) to cool the end portion of the discharge pipe (211), and a bottom of the end water-cooling pipeline (38) protrudes so that the heat insulation valve (212) is closed at the discharge port in an inclined closed state;

wherein the heat insulation valve (212) is rotatably provided at the discharge port, and a hinge or pivot axis (213) of the heat insulation valve (212) is provided above the discharge port and above the end water-cooling pipeline (38);

wherein a seat (33) fixedly connected to the lower vessel (3) is provided between the rotatable distributor (32) and the integrated grate (31), and a periphery of the seat (33) envelops the support tray (321) upward to form a dustproof cap (331);

wherein the seat (33) is connected to a plurality of fastened water-cooling pipelines (34), one end of each water-cooling pipeline (34) is connected to the lower vessel (3), the other end thereof is connected to the seat (33), and each water-cooling pipeline (34) is arranged above the surface of the integrated grate (31) to agitate and stir materials on the surface of the integrated grate (31), and the water-cooling pipeline (34) is of a hollow structure with circulating cooling water circulating within the hollow structure;

wherein the integrated grate (31) is integrated with an air inlet pipe (35), and an air inlet of the air inlet pipe (35) is introduced at a bottom of the integrated grate (31);

wherein the pyrolysis reactor further comprises a modular ash/char discharge unit (4) detachably provided at a bottom of the lower vessel (3), a circular strip-shaped ash/char discharge port (36) being formed between the bottom of the surface of the integrated grate (31) and an inner wall of the lower vessel (3), and after reaction is completed, waste ash/char enters the ash/char discharge unit (4) through the ash/char discharge port (36); and wherein respective corresponding joins of the upper vessel (1), the middle vessel (2), the lower vessel (3), and the ash/char discharge unit (4) each are a ring fit, to horizontally implement modular assembly adjustable in any direction.

2. The pyrolysis reactor according to claim 1, wherein the discharge pipe (211) is provided with an external insulation structure to isolate a temperature inside the pyrolysis reactor, so as to avoid an excessively high temperature inside the discharge pipe (211), and the external insulation structure is an insulation layer or a water-cooled insulation device.

3. The pyrolysis reactor according to claim 1, wherein the material distribution tower (322) is rotatably provided on the support tray (321).

4. The pyrolysis reactor according to claim 3, wherein the material distribution tower (322) is further provided with a blade (323) configured to push materials outward.

* * * * *